US006109801A

United States Patent [19]

Mabit

[11] Patent Number: 6,109,801

[45] Date of Patent: Aug. 29, 2000

[54] RIBBON CORE AND SPINDLE

[75] Inventor: Stephane Mabit, rue de la Roseraie, France

[73] Assignee: Eltron International, Inc., Camarillo, Calif.

[21] Appl. No.: 09/271,505

[22] Filed: Mar. 18, 1999

[51] Int. Cl.[7] ..... B65H 75/00

[52] U.S. Cl. ..... 400/242; 400/248

[58] Field of Search ..... 400/242, 197, 400/202.1, 207, 208.1, 247, 248

[56] References Cited

U.S. PATENT DOCUMENTS 3,679,039 7/1972 Landgraf ..... 400/207

5,141,342 8/1992 Kawahara ..... 400/207

*Primary Examiner*—John S. Hilten

*Assistant Examiner*—Darius N. Cone

*Attorney, Agent, or Firm*—Fulbright & Jaworski L.L.P.

[57] ABSTRACT

An ribbon spool and associated mounting spindle for a printer incorporates multiple longitudinal ribs on the spindle that fit into multiple longitudinal slots in the spool to acquire rotational lock between the spindle and spool. A latch at the end of selected ribs interacts with a lock ridge within the spool to acquire longitudinal lock between the spindle and spool. Placing the lock ridge near one end effectively prevents the spool from being inserted from the wrong end. The latch includes a spring-loaded detent action to hold the spool in place until an operator exerts sufficient force to overcome the latch for removal and replacement of the spool. The inner cylindrical surface of the spool is also designed to work properly with conventional spring-loaded frictional force spindles. However, the reverse is not true. Due to the sloping alignment edges on the ribs of the instant spindle, conventional spools may be blocked, thus preventing improper insertion of the old spools onto the new spindles.

9 Claims, 4 Drawing Sheets

FIG. 3
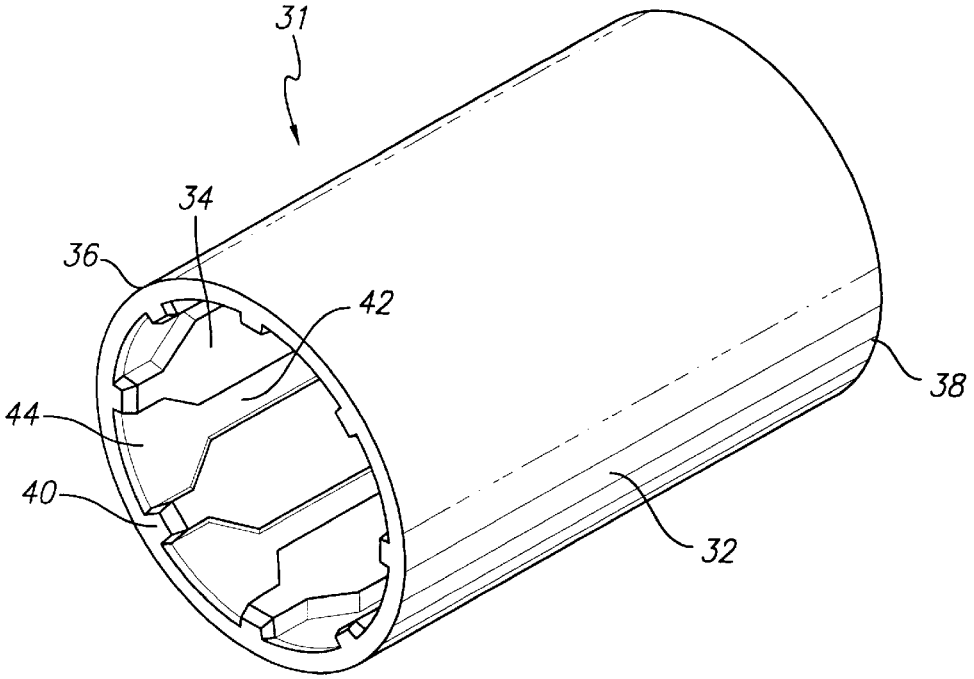
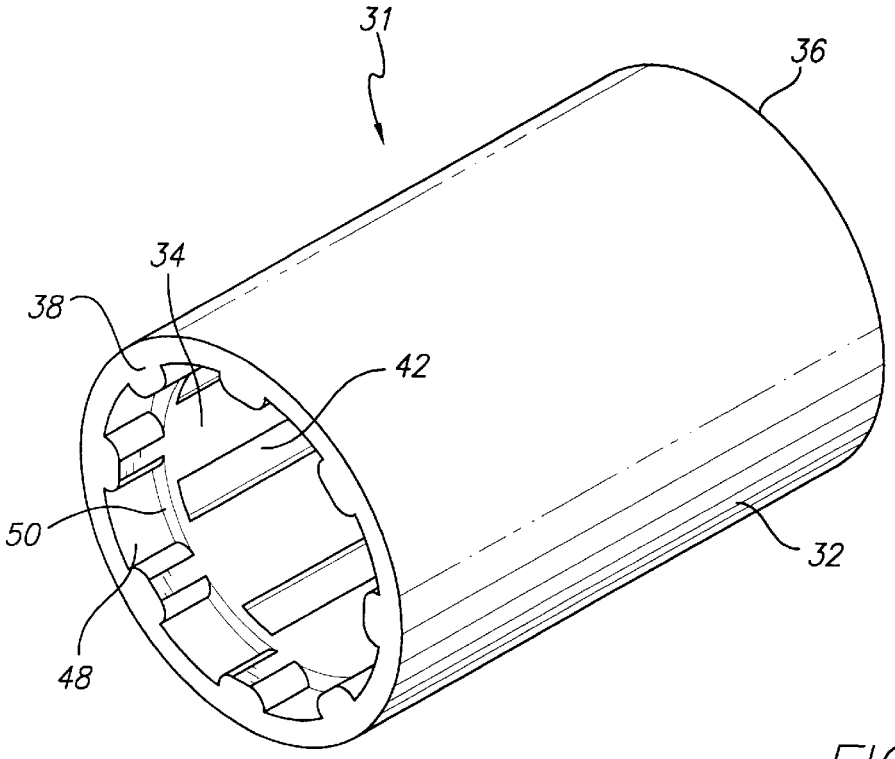
FIG. 4

RIBBON CORE AND SPINDLE

BACKGROUND OF THE INVENTION

1. Field of the Invention

The invention pertains to printer ribbon spools, or cores, and the spindles for holding them. More particularly, it pertains to a novel configuration of core and spindle that permits quick and easy replacement of used printer ribbons and more accurate control over the printer ribbon during use.

2. Description of the Related Technology

In the field of printer technology, a number of different methods have been developed for applying ink to paper, cards, or other print media in a controlled manner. One of the more common methods is through the use of ink ribbons. A flexible ribbon-shaped substrate is impregnated or coated with an ink that readily adheres to paper or plastic card. Although "ink" is the term commonly used in describing this technology, the substance used for printing is typically not an ink in the popular sense of the word. Porous (e.g., cloth) ribbons are usually impregnated with a dark powder which has just enough liquid or gel content to promote its binding characteristics. Non-porous ribbons are typically coated on one side with a dry paste-like substance. In either case, the substance is usually referred to as "ink", and the ribbons as "ink ribbons". Regardless of its technical accuracy, this terminology is common in the industry and is used in the following descriptions. The terminology and technology of printer inks is known and will not be further described here. At the time of printing, the back side of the ribbon is driven by one or more "hammers", which drive the front side of the ribbon against the paper or plastic card being printed upon. This pressure and/or the temperature of these "hammers" transfers some of the ink from the ribbon to the paper or card, leaving an ink deposit on the paper's or card's surface in the shape of the hammer's impact surface. The surface of this hammer may be in the shape of a particular character (e.g., the letter "A"), or a single dot which is combined with other dots to form a character. In either case, the method of transferring ink from ribbon to paper or card is the same. This technology is also known, and will not be further described here.

Because this process removes ink from the ribbon during printing, the ink content of any given portion of the ribbon will be reduced until that area of the ribbon becomes unsuitable for further printing. The ribbon shape was created specifically to address this problem. By moving the ink ribbon past the printed area, a fresh portion of the ribbon will be ready for printing. By supplying fresh ribbon from a supply spool, and recovering the used ribbon on a takeup spool, several feet of printer ribbon (and fresh ink) can be provided in a comparatively small space. For single-pass ribbons, which are usually associated with high print quality, the ribbon advances from one end to the other and is then replaced. Although this process extends the ribbon's effective life, the entire ribbon will eventually become unusable and must be replaced.

In addition to standard ink ribbons and hammers, various other printer technologies have also been developed, such as Thermal Transfer, Hot Transfer, Die Sublimation Transfer, etc. Although these technologies differ from each other in significant ways, two things they have in common are that they typically involve a controlled transfer of the print substance from a substrate onto the print media, and the act of printing depletes the print substance so that the substrate must periodically be replaced. The use of replaceable ribbons, supply spools, and takeup spools is therefore common in many different types of printers. The term "ribbon", as used herein, is meant to encompass any type of printer technology that employs a flat, linear material wound around a spool.

Since replaceability is a requirement for printer ribbons, most printers that use ribbons mounted on spools are designed so that the spool containing the ribbon can be replaced by the operator. Spools are also called "cores", and ribbon/spool combinations are usually sold as a single item. Typically each spool will be mounted on a spindle for operation, the spindle being generally cylindrical in shape and attached to a motor-operated assembly that accurately controls the rotation of the spool. In most cases, only the takeup spool is controlled, while the supply spool is allowed to rotate freely as ribbon is removed from it by the force exerted on the ribbon by the takeup spool. Alternately, the supply spool may also be controlled to help maintain tension in the ribbon. These aspects of ribbon control are known in the art and are not further described here.

The interface between the spindle and the replaceable spool must meet multiple and sometimes conflicting requirements. Removal of the used spool from the spindle and insertion of a new spool on the spindle should both be capable of being accomplished quickly without tools by a non-technical person with little or no instruction. In addition, the interface between the spindle and a mounted spool should be firm enough to keep the spool accurately controlled during operation. Conventional spindle/spool assemblies attempt to accomplish this in one of two ways.

In the first, a protrusion on the outer surface of the cylindrical spindle fits into a recess in the inner surface of the spool (or vice-versa). For proper insertion, the protrusion and recess must be aligned, which requires that the spool be rotated up to 180 degrees before the spool will slip onto the spindle. Without more, this arrangement does not provide protection against longitudinal slippage of the spool during operation, with the resultant possibility that the ribbon will become misaligned with the print area, or that the spool may even slip off the spindle.

In the second approach, a leaf spring or other spring-loaded assembly on the spindle is used to apply pressure to the spool, thus creating a frictional connection which is subject to slippage, both rotationally and longitudinally. Such slippage can be quite detrimental to the proper operation of the ink ribbon.

These conventional spindle/spool assemblies suffer from a number of operational shortcomings, such as:

1) When a new ribbon is installed, the spool can be installed upside down. This places the ink side of the ribbon against the printhead, which can damage the printhead.

2) The spool and spindle are typically made of multiple parts, which increases manufacturing costs.

3) Some spindles have a large outside diameter, which requires a large inside diameter on the spool, reducing its ribbon capacity.

4) Many spool/spindle combinations have a friction mount and can therefore suffer from rotational slippage.

5) Conventional spools and spindles do not have angled surfaces to guide the insertion process. This makes it more difficult to install a new ribbon on the printer, since the spool must be accurately aligned with the spindle by hand before insertion, and this alignment is often "blind" because the spool obscures the operator's view of the spindle.

6) Longitudinal slippage during printing is not prevented. This is typically corrected by making the ribbon wider than the printed area, thereby unnecessarily wasting ribbon material and increasing its cost.

7) No automatic locking system informs the operator when the spool is entirely inserted onto the spindle, increasing the chance of improper mounting.

8) Finger pressure exerted by the operator for insertion or removal is not moderated.

9) Spools with inner cylindrical surfaces can easily be inserted onto incorrect spindles. This permits undetected use of the wrong spool, resulting in improper operation and possible damage.

What is needed is a spindle/spool design that permits a spool to be inserted on a spindle with minimal rotation of the spool for alignment purposes, that provides effective locking to prevent longitudinal and rotational slippage, that prevents incorrect installation of the correct spools and installation of incorrect spools, and that permits quick and easy insertion/removal of the spool by an untrained operator by correcting for misalignment during the insertion process.

SUMMARY OF THE INVENTION

The present invention provides a solution to the above problems by providing a spindle and spool that fit together using one or more indent assemblies for longitudinal lock and multiple slots and ribs for rotational lock. In a preferred embodiment, the spool can have a generally cylindrical hollow shape with an inner cylindrical surface that has multiple longitudinal slots, while the mating spindle has multiple longitudinal ribs for fitting in the slots and a mount at one end for mounting the spindle onto a ribbon control mechanism. A preferred embodiment can also have a lock ridge located anywhere along the inner surface of the spool, while the spindle can have at least one latch near the end opposite the mount for latching the lock ridge. Alternatively, the slots and ridge can be formed on the spindle, with the corresponding ribs and latch on the inner surface of the spool.

The method of using the invention is to insert the spool onto the spindle, using a combination of angled surfaces to guide the spool into alignment so that ribs on the spindle are inserted into slots in the spool, and then pushing the spool further onto the spindle until at least one latch on the spindle interacts with the lock ridge on the spool to lock the spool in place.

BRIEF DESCRIPTION OF THE DRAWINGS

FIG. 3 is a perspective view showing one end of the spool.

FIG. 4 is a perspective view showing the other end of the spool.

DETAILED DESCRIPTION OF THE PREFERRED EMBODIMENT

Figure 1:
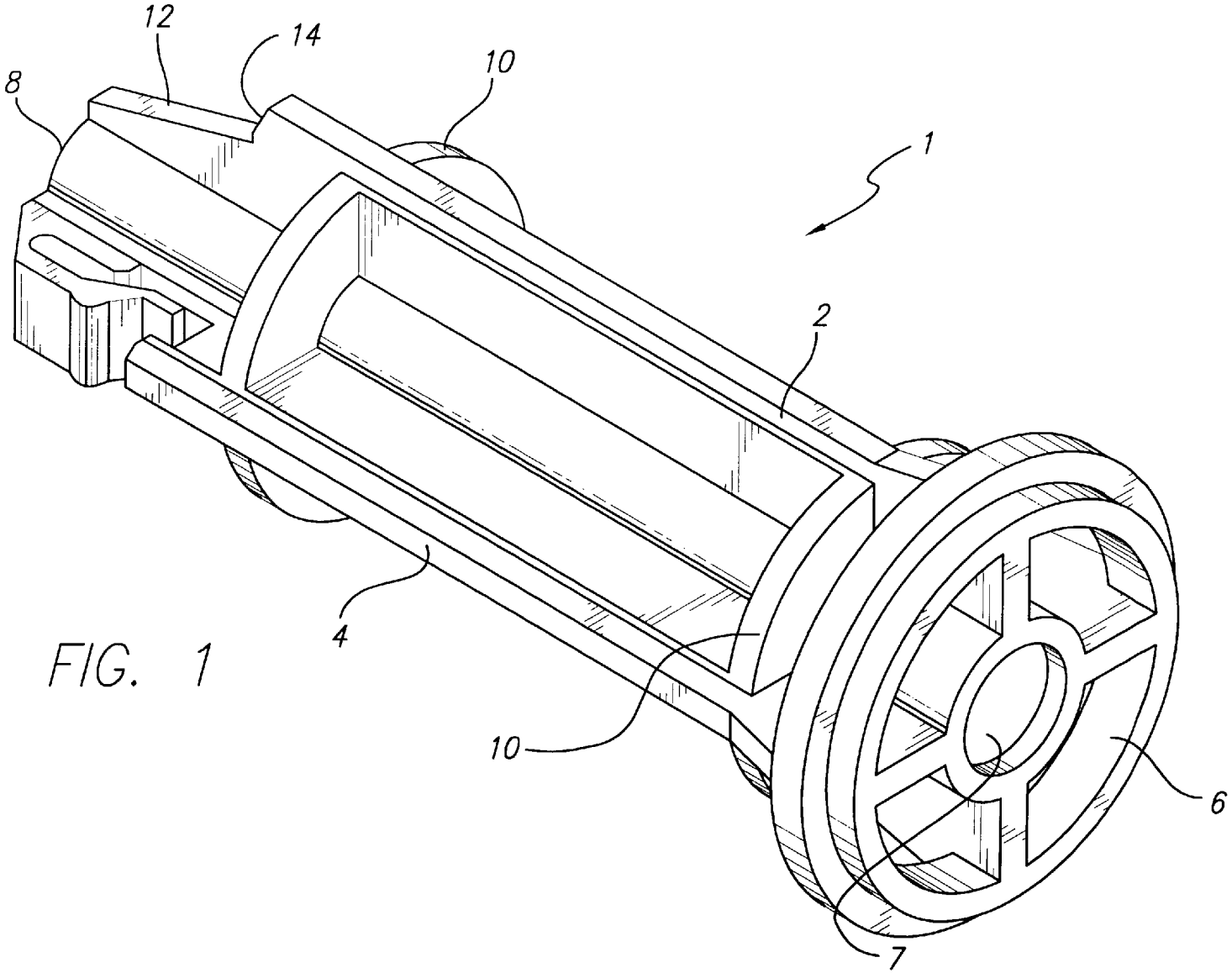
FIG. 1 is a perspective view of the spindle.
Figure 2:
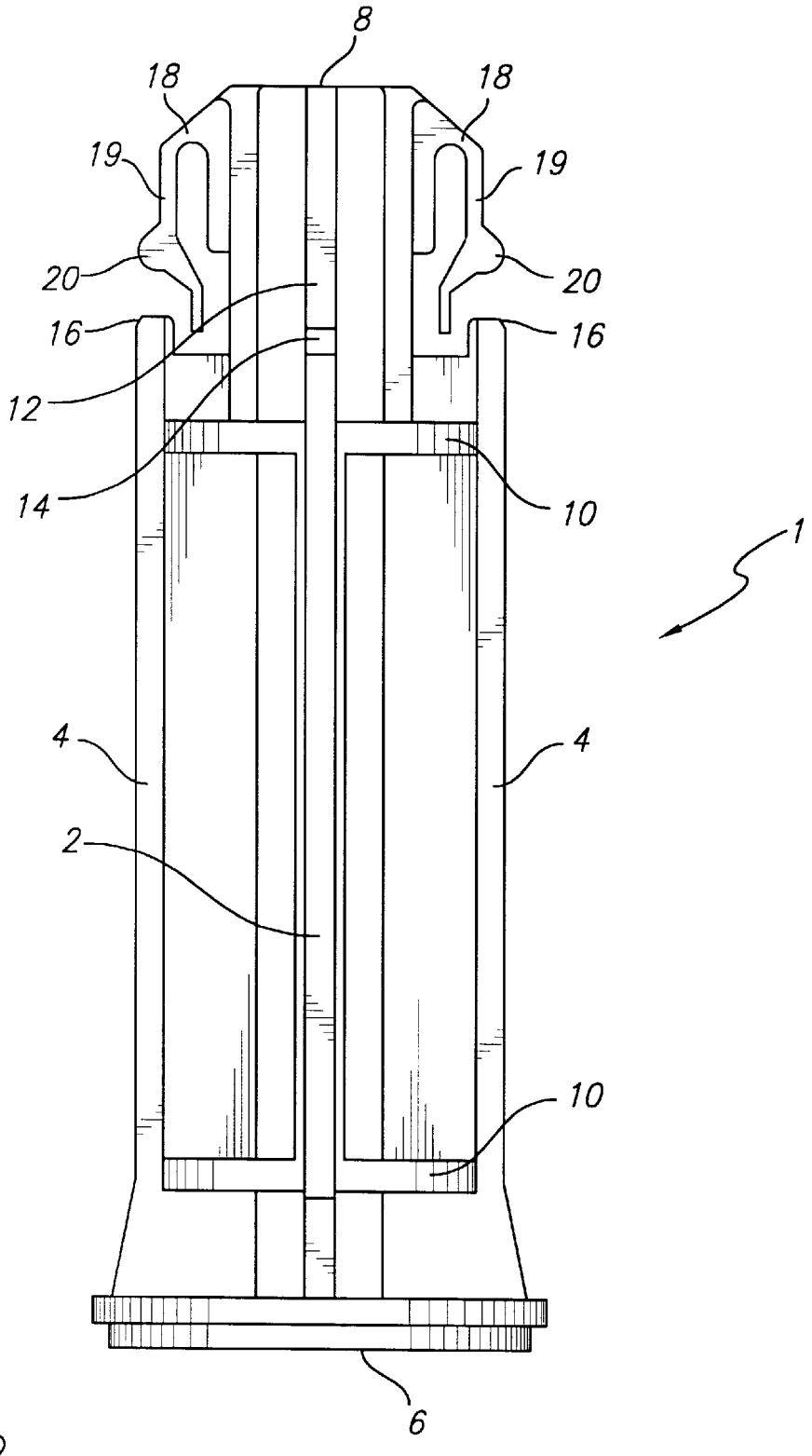
FIG. 2 is a side view of the spindle.

The present invention can include two separate pieces—the spindle and the spool. Although the two are designed to fit together, the spool is designed so that it may also be used on some conventional spindles. FIGS. 1 and 2 show two views of spindle 1, while FIGS. 3 and 4 show two views of spool 31. FIG. 5 shows how spindle 1 and spool 31 interact to create a firm locking action for operation.

FIG. 1 shows a perspective view of spindle 1. As can be seen, the overall frame of the spindle is shaped to mate with the inner surface of a cylindrical space in spool 31. Ribs 2 and 4 run longitudinally along the outer areas of the spindle, preferably covering most of the length of the spindle. In a preferred embodiment, there are two ribs 2 on opposite sides of spindle 1, and two ribs 4, also on opposite sides of spindle 1. One end of the spindle, referred to as mounting end 6, is configured for attaching spindle 1 to a drive mechanism (not shown), such as the shaft of a servo motor. In the preferred embodiment shown, this mounting facility consists of cylindrical hole 7, but other configurations are also possible, depending on the requirements of the drive mechanism. Mounting end 6 can also have a larger diameter than that formed by the ribs, to create a 'stop' that limits the longitudinal travel of the spool when it is fully inserted onto spindle 1. Reinforcements 10 provide structural strength for ribs 2, 4, and for additional stability can also be shaped to contact the inner surfaces of spool 31.

The opposite end of spindle 1 is referred to as insertion end 8 because spool 31 can be inserted onto spindle 1 from that end. Ribs 2 can incorporate a radially inward taper 12 as they approach insertion end 8. This facilitates easier insertion of the spool onto the spindle by 'guiding' spool 31 until its axis coincides with the axis of spindle 1. In a preferred embodiment, each of ribs 2 may also have a shoulder 14, for use as a stop to limit the longitudinal travel of spool 31 onto spindle 1. The interaction of this shoulder with the spool is described later in more detail.

FIG. 2 shows that each of ribs 4 can terminate in a shoulder 16, which serves the same purpose as shoulder 14 on rib 2. However, rather than continuing the rib with a taper, latch 18 is disposed between end 8 and shoulder 16. Latch 18 can be formed as shown to include raised knob 20, which has a relatively rounded or angular shape, disposed at the end of bendable arm 19. In a preferred embodiment, latch 18 is formed of the same material, such as plastic or metal, that is used to construct the entire spindle 1, which is molded as a single unit. In operation, whenever spool 31 is inserted onto spindle 1, knob 20 will be pushed radially inward toward the axis of spindle 1, which is possible because of the flexible nature of bendable arm 19. Once a lock ridge in spool 31 passes knob 20, knob 20 is allowed to spring back to its normal position, leaving the lock ridge between knob 20 and shoulder 16. The longitudinal position of spool 31 on spindle 1 is thus locked in place. This is described later in more detail with reference to FIGS. 5A–C.

FIG. 3 shows spool 31, which has a generally cylindrical shape. Spool 31 serves as a core for an ink ribbon (not shown), which is typically wrapped around outer surface 32 of spool 31. Once the end of the ribbon is attached to spool 31 through any appropriate means, the ribbon can be wound or unwound from outer surface 32, which preferably has a cylindrical shape. FIG. 3 shows inner surface 34, which also has a generally cylindrical shape, but which is modified with a series of slots and other recessed formations. These formations can be seen through insertion end 36, so named because this end of spool 31 is inserted onto spindle 1. FIG. 3 shows a series of slots 42 running longitudinally along inner surface 34. Slots 42 have a depth and width that will allow ribs 2, 4 of spindle 1 to fit into them. In a preferred embodiment, there are eight slots 42, equally spaced around inner surface 34. Near insertion end 36, slots 42 flare in a circumferential direction into insertion channels 44, which are wider than slots 42. Insertion channels 44 also taper radially outwardly as they approach end 36, so that the wall of spool 31 is thinnest at the very edge. The full thickness of the spool wall is carried to end 36 only at points 40. This tapered surface of insertion channels 44, working in conjunction with rib taper 12, aids initial insertion of spool 31 onto spindle 1 by guiding spool 31 into a centered position so that the axis of the spool coincides with the axis of the spindle. The narrowing of insertion channels 44 then guides ribs 2,4 in a circumferential direction into slots 42. The combination of the radially inward taper on the end of ribs 2,4, the radially outward taper of insertion channels 44, and the circumferentially flared sides of insertion channel 44 at the end of each slot 42, permits a great deal of misalignment, both axially and circumferentially, when the operator initially inserts spool 31 onto the end of spindle 1. The operator then only needs to push spool 31 further onto spindle 1 in a longitudinal direction, while the aforementioned tapers and flares automatically guide spool 31 into correct alignment with spindle 1. Slots 42 and insertion channels 44 can be equally spaced and identically sized so that any of ribs 2,4 will fit into any of slots 42. Thus, the operator does not have to rotate spool 31 at all to achieve proper alignment for insertion of spool 31 onto spindle 1. A minor exception to this occurs when spool 3 1 is inserted so that ribs 2, 4 are directly in line with points 40. Even in this case, the spool only needs to be rotated by, at most, the width of point 40 to move ribs 2,4 into an insertion channel. This avoids the problem encountered with conventional spool/spindle combinations that have a single rib and single slot, and must be rotated up to 180 degrees by the operator before the spool can be inserted onto the spindle. Moreover, due to sloping insertion channels 44 and spindle rib tapers 12, conventional spools with inner cylindrical surfaces may be prevented from being completely inserted onto spindle 1, thus preventing inadvertent insertion of the wrong type of spools.

FIG. 4 shows the inner surface of spool 31 from the opposite end, referred to as mounting end 38. As can be seen, each slot 42 terminates abruptly, followed by a wider slot 48. The non-recessed area between slot 42 and slot 48 forms a ridge called lock ridge 50. There can be one lock ridge 50 for each slot 42 or slot 48. Lock ridge 50 operates in conjunction with latch 18 of spindle I to lock spool 31 to spindle 1. During insertion of spool 31 onto spindle 1, knob 20 of latch 18 moves along slot 42 until it passes lock ridge 50. Further travel causes knob 20 to drop down into slot 48, so that ridge 50 is caught between knob 20 and shoulder 16 of rib 4. This effectively locks ridge 50 in place, preventing longitudinal movement of spool 31 with respect to spindle 1. This operation is described in more detail below with reference to FIGS. 5A–C.

Rather than having multiple slots 48, the entire inner surface of the spool between lock ridge 50 and mounting end 38 can be recessed, which turns lock ridge 50 into a continuous annular ring rather than a separate ridge for each slot 42. This choice has no effect on the operation of the invention, and is mainly a matter of manufacturing preference.

Spool 31 is also locked in place in the rotational, or circumferential, direction. During insertion, ribs 2, 4 of spindle 1 become inserted into slots 42. The width of ribs 2, 4 and slots 42 are sized to maintain a snug fit, so that the rotation of spool 31 accurately follows the rotation of spindle 1. Due to the longitudinal locking action and rotational locking action just described, the instant invention does not suffer from the slippage that can be encountered by conventional spring-loaded frictional connections.

Figure 5A:
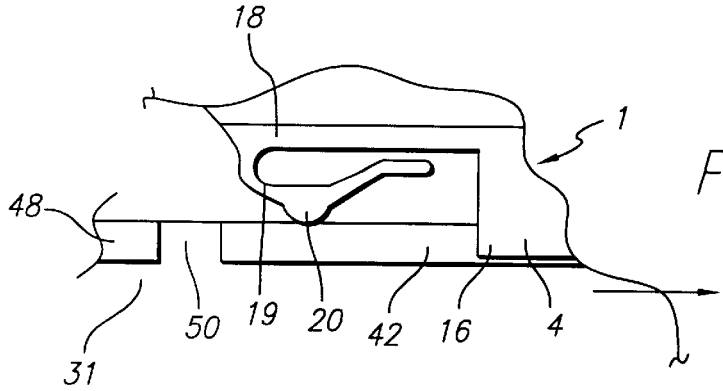
FIGS. 5A, 5B, and 5C are views of the interaction between the latch and the lock ridge.
Figure 5B:
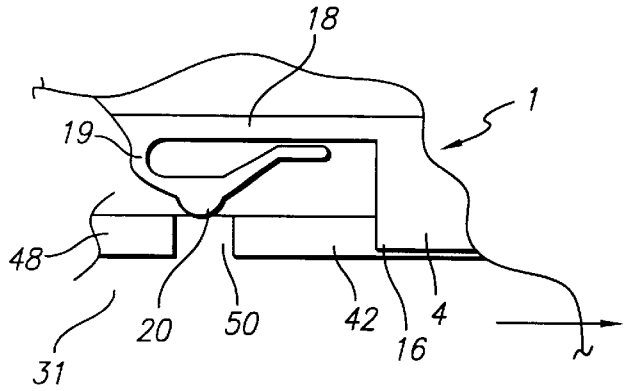
Figure 5C:
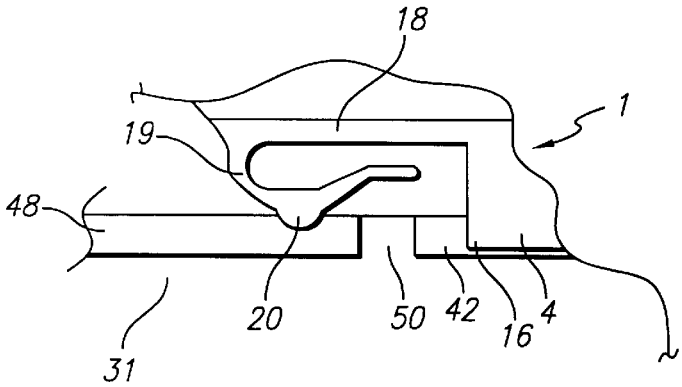

FIGS. 5A, 5B, and 5C show in more detail the spring-loaded detent mechanism of a single latch 18, and its interaction with a corresponding lock ridge 50. With reference to FIG. 5A, after spool 31 has been partially inserted onto spindle 1, rib 4 will be seated within a slot 42, and will slide longitudinally within slot 42 as spool 31 moves in the direction of the arrow. If knob 20 is wider than slot 42, knob 20 will be pushed radially inward so that it rides above slot 42 as shown. The spring-like characteristics of arm 19 allow this radial deformation of latch 18 to take place. In a preferred embodiment, these characteristics are achieved through the deformable nature of the material from which arm 19 is constructed. However, other methods of achieving the desired spring loading can also be used. At some point, knob 20 will pass lock ridge 50. Because slot 48 is wider than knob 20, further travel by spool 31 allows knob 20 to drop down on the other side of lock ridge 50 into slot 48 as shown in FIG. 5C. Further travel is prevented because shoulder 16 at the end of rib 4 blocks ridge 50 from any further movement in the previous direction. Shoulder 14 on rib 2 can have the same effect. However, motion in the reverse direction is possible because the shape of knob 20, which is rounded or angular, allows knob 20 to ride up onto ridge 50 as shown in FIG. 5B if the longitudinal force applied to spool 31 in the opposite direction is sufficient to overcome the spring force in arm 19. Such force is absent during normal operating conditions, but can be applied by an operator attempting to remove spool 31. Thus spool 31 is effectively locked in place until an operator decides to remove it. Removal just reverses the sequence of events described for insertion.

In a preferred embodiment, knob 20 is wider than slot 42 and follows the sequence just described. But knob 20 can also be narrower than slot 42, in which case it will ride within slot 42 during insertion. When ridge 50 is encountered, the rounded or angular shape of knob 20 can allow it to ride up and over ridge 50 from either direction. In a preferred embodiment, this action allows insertion and removal to operate smoothly, without any "hard" contact points that might require excessive force from the operator.

In a preferred embodiment, there are two latches 18, thus doubling the force required to overcome the spring force of the preceding example. By placing the two latches opposite each other, the insertion forces will be balanced, thus helping to keep the spool properly aligned. Additional latches 18 can also be used. Regardless of the number of latches used, the total spring force in the latches should be larger than the longitudinal forces encountered during operation of the printer, but smaller than moderate finger pressure exerted by the operator for insertion or removal. The determination of this range is well within the abilities of the person of ordinary skill in this art. The use of multiple latches also provides redundancy in the event that a latch breaks off or becomes defective. Lock ridge 50 also serves another purpose. Since lock ridge 50 is located near mounting end 38 of spool 31, and shoulders 14, 16 cannot get past lock ridge 50, any attempt to insert spool 31 from the wrong end will be prevented. This feature can help prevent the operator from loading the ink ribbon in the printer incorrectly.

For economic reasons, some printer operators may have to temporarily continue using conventional printers with conventional spindles, possibly creating a mixture of conventional spindles and the improved spindles of this invention in the same office. Rather than being forced to keep both kinds of printer spools in inventory, the spools of the instant invention might also be used with conventional spring-loaded spindles. The generally cylindrical inner surface of the spool can provide a surface against which the spring of a conventional spindle can provide its normal frictional force in a conventional manner.

The embodiments described herein are intended to be illustrative and not restrictive. Other variations will occur to those of skill in the art. For example, the spool could also be used to hold paper rolls. The invention is intended to encompass all such variations and be limited only by the spirit of the appended claims.

What is claimed is:

1. A ribbon spool and spindle assembly comprising:

a spindle comprising:

at least one rib having a shoulder;

at least one latch, the latch having a sloped side; and a spool comprising:

at least one slot for engaging the rib, the slot having an outwardly angled insertion channel for guiding the latch to the slot as the spool is inserted on the spindle;

a lock ridge;

the latch being adapted to engage between the lock ridge and the rib shoulder upon insertion of the spool in order to lock the spool in place, the latch sloped side being adapted to allow the latch to disengage the rib so that the spool may be manually pulled off of the spindle.

2. The ribbon and spool assembly of claim 1, wherein the ridge is adapted to engage the shoulder upon insertion of the spool onto the spindle to prevent further insertion of the spool.

3. The ribbon and spool assembly of claim 1, wherein the ridge is adapted to engage the shoulder upon insertion of the spool onto the spindle to prevent insertion of the spool from the wrong end.

4. The ribbon and spool assembly of claim 1, wherein the latch engagement between the ridge and the shoulder is adapted to accurately control the spool in order to prevent undesired motion of the spool.

5. The ribbon and spool assembly of claim 1, wherein the latch is spring loaded, the latch being adapted to be locked between the rib and the shoulder, the latch engagement being adapted to prevent longitudinal movement of the spool with respect to the spindle.

6. The ribbon and spool assembly of claim 1, wherein the latch is adapted to ride up the sides of the slot to compress the latch, and is further adapted to spring into a space between the ridge and the shoulder.

7. The ribbon and spool assembly of claim 1, wherein the latch is normally urged outwardly.

8. A spool adapted to be inserted onto a spindle and having at least one slot for engaging a rib of a spindle, the slot having an outwardly angle insertion channel for guiding a spindle latch to the slot as the spool is inserted on the spindle, the spool further having a lock ridge, the spindle comprising:

at least one rib having a shoulder;

at least one latch, the latch having a sloped side, the latch being adapted to engage between the lock ridge and the rib shoulder upon insertion of the spool in order to lock the spool in place, the latch sloped side being adapted to allow the latch to disengage the rib so that the spool may be manually pulled off of the spindle.

9. A ribbon and spool assembly comprising:

a spindle comprising:

a rib having a shoulder;

a spool comprising:

at least one slot for engaging the rib, the slot having means for guiding a locking means to the slot as the spool is inserted onto the spindle;

means for locking the spool to the spindle upon insertion of the spool onto the spindle, said locking means being adapted to be disengaged by manually pulling the spool off of the spindle.

* * * * *

UNITED STATES PATENT AND TRADEMARK OFFICE

CERTIFICATE OF CORRECTION

PATENT NO. : 6,109,801
DATED : August 29, 2000
INVENTOR(S) : Stephane Mabit

It is certified that error appears in the above-identified patent and that said Letters Patent is hereby corrected as shown below:

In [75] delete "ru de la Roseraie" and insert -- Varades -- therefor.

Signed and Sealed this

Fifth Day of June, 2001

Nicholas P. Godici

*Attest:*

NICHOLAS P. GODICI

*Attesting Officer*

*Acting Director of the United States Patent and Trademark Office*